US008743009B2

(12) United States Patent
Packer

(10) Patent No.: US 8,743,009 B2
(45) Date of Patent: Jun. 3, 2014

(54) ORTHOGONAL FEED TECHNIQUE TO RECOVER SPATIAL VOLUME USED FOR ANTENNA MATCHING

(75) Inventor: Malcolm Packer, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 369 days.

(21) Appl. No.: 13/213,723

(22) Filed: Aug. 19, 2011

(65) Prior Publication Data

US 2013/0044038 A1 Feb. 21, 2013

(51) Int. Cl.
*H01Q 9/16* (2006.01)

(52) U.S. Cl.
USPC ..... 343/822

(58) Field of Classification Search
USPC ..... 343/822, 895, 702, 700 MS, 711–713
See application file for complete search history.

(56) References Cited

U.S. PATENT DOCUMENTS 4,137,534 A 1/1979 Goodnight
4,161,737 A 7/1979 Albright
4,772,895 A 9/1988 Garay et al.
4,940,989 A * 7/1990 Austin ..... 343/749
5,231,412 A * 7/1993 Eberhardt et al. ..... 343/790
5,563,615 A 10/1996 Tay et al.
5,812,097 A * 9/1998 Maldonado ..... 343/790
6,107,972 A * 8/2000 Seward et al. ..... 343/722
7,817,103 B2 10/2010 Kersten et al.
8,115,690 B2 * 2/2012 Koh et al. ..... 343/702

* cited by examiner

*Primary Examiner* — Huedung Mancuso
(74) *Attorney, Agent, or Firm* — Fox Rothschild, LLP; Robert J. Sacco

(57) ABSTRACT

A method and apparatus for reducing a length of an antenna (402) involves an arrangement which includes an orthogonal antenna feed. An antenna includes a radiating element (404) with a length extending along an axis (418). The orthogonal feed arrangement permits recovery of a portion of the spatial volume comprising the antenna which is normally used for antenna matching circuitry (406). An end portion of the radiating element is chosen to be helically shaped and includes an RF feed gap. The RF feed gap is coupled to a matching network which includes elongated conductors (412). The matching circuitry is positioned so that the elongated conductors are adjacent to the first end portion and extend in a direction aligned with the axis, but orthogonal to the coils forming the helically shaped end portion.

15 Claims, 6 Drawing Sheets

ORTHOGONAL FEED TECHNIQUE TO RECOVER SPATIAL VOLUME USED FOR ANTENNA MATCHING

BACKGROUND OF THE INVENTION

1. Statement of the Technical Field

The inventive arrangements relate to antennas, and more particularly to broadband antennas for portable devices 2. Description of the Related Art Short flexible monopole antennas are commonly used for portable communication devices. For example, Harris Corporation of Melbourne, Fla. offers a broadband blade antenna (Model No. 12011-2710-01) which operates over a 30 to 512 MHz frequency range and is 13 inches long, and a unity gain rubber-duck antenna (Model 12102-2700-01) which operates over (30-870 MHz), which is only 9 inches long. These antennas are compact in size to satisfy customer demands. However, antenna size also has an effect on antenna performance, and it is common for smaller antennas to sacrifice performance to facilitate smaller physical size.

Antenna matching networks are often required in order to facilitate use of a single antenna over a broad range of frequencies. These matching networks perform an impedance transformation function. At each frequency of operation, the matching network transforms an impedance of the antenna to approximately match the input or output impedance of the communication device. This impedance matching function facilitates efficient power transfer between the antenna and the communication device. Matching networks can be formed from lumped elements, RF transmission line sections, or a combination of the two.

Some short flexible monopole antenna designs include matching networks integrated directly into the antenna assembly. Usually, the matching network is integrated into the base of the antenna, near where it connects to the portable communication device. Typically the matching network extends from an output port or antenna connector of the portable communication device, to a base end of the monopole antenna radiating element that is nearest to the radio. Consequently, the RF feed gap of the monopole radiating element may be spaced somewhat away from the chassis of the portable radio in order to accommodate the physical length of the matching network. From the foregoing, it can be understood that a first portion of the overall length of the antenna can be allocated to the matching network and a second portion of the overall length can be allocated to the radiating element. Consequently, the overall length of the antenna assembly is directly affected by the size and arrangement of the matching network. The matching network can be relatively large, particularly when an antenna is designed for handling relatively high power levels. For a fixed length matching network, the relative or percentage portion of the overall antenna length devoted to the matching network actually increases as the radiating element length is decreased.

SUMMARY OF THE INVENTION

Embodiments of the invention concern an antenna and a method of making an antenna which facilitates recovering the length of a radiating element that is normally sacrificed in an vertical monopole antenna design to accommodate a matching network. The invention can also be thought of as facilitating a reduction in overall length of a vertical monopole antenna by having a first part of the vertical radiating element occupy the same volume as the matching network.

The antenna of the present invention includes at least one elongated radiating element having a length extending along an antenna axis. The radiating element has a first end portion including an RF feed gap, and a second end opposed to the first end portion. At least a portion of the elongated radiating element closest to the feed gap is arranged to have a helical form comprised of a plurality of coils. The helical form has a helical axis which can be centered on the antenna axis.

A matching network is at least partially disposed within a volume enclosed by the plurality of coils. The matching network is operative to provide an impedance transformation to approximately match an impedance of the radiating element to a portable communication device over a range of frequencies. According to one aspect of the invention, substantially an entire elongated length of the matching network is disposed within the plurality of coils. The matching network will generally include a plurality of lumped element components, and an elongated conductor extending in a direction aligned with the axis. Notably, a conductor forming the plurality of coils is substantially orthogonal to the elongated conductor of the matching network, at least in an area of the helical form nearest the feed gap. The helical form has a coil diameter, a coil pitch and wire diameter which, in combination, are of a configuration operative to achieve a diminution in a reduction in a radiation resistance of the antenna caused by a proximity of the elongated conductor to the feed gap.

In some embodiments, an RF connector extends from the first end portion of the radiating element, and can be electrically coupled to the matching network. The elongated conductor can be electrically connected to the RF connector proximal to a bottom end of the matching network. In such arrangements the elongated conductor extends along a path from the bottom end to a location proximal to an opposing top end, and then continues to a location proximal to the bottom end, where the elongated conductor is electrically coupled to the first end portion of the radiating element. Notably, the antenna of the present invention can be a monopole radiating element, or can be formed as a dipole antenna including two elongated radiating elements.

The invention also concerns a method for reducing a length of an antenna. The method can include forming at least one elongated radiating element having a length extending along an antenna axis, such that the radiating element has a first end portion and a second end portion opposed to the first end portion. The method can continue with arranging at least a portion of the elongated radiating element closest to the feed gap to have a helical form. The helical form can be made of a plurality of coils, such that the coils define a helical axis that is substantially centered on the antenna axis. The method also includes locating an RF feed gap at the first end portion, and coupling the RF feed gap to a matching network including an elongated conductor.

The matching network is advantageously positioned at least partially within a volume enclosed by the plurality of coils so that the elongated conductor extends in a direction aligned with the antenna axis. In some embodiments, the method can include disposing substantially an entire elongated length of the matching network within the plurality of coils. The matching network is positioned such that the elongated conductor is substantially orthogonal to a conductor forming the plurality of coils, at least in an area of the helical form nearest the feed gap. Finally, the method includes selectively determining a coil diameter, a coil pitch and wire diameter of the helical form to achieve a decreased reduction in a radiation resistance of the antenna caused by a proximity of the elongated conductors to the feed gap.

The method can also include positioning an RF connector at the first end portion of the radiating element, and electrically coupling the RF connector to the matching network. Further, the method can include coupling the elongated conductor to the RF connector proximal to a bottom end of the matching network. The elongated conductor can run from the bottom end to a location proximal to an opposing top end, and then continue to a location proximal to the bottom end, where the elongated conductor is coupled to the first end portion of the radiating element.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1:
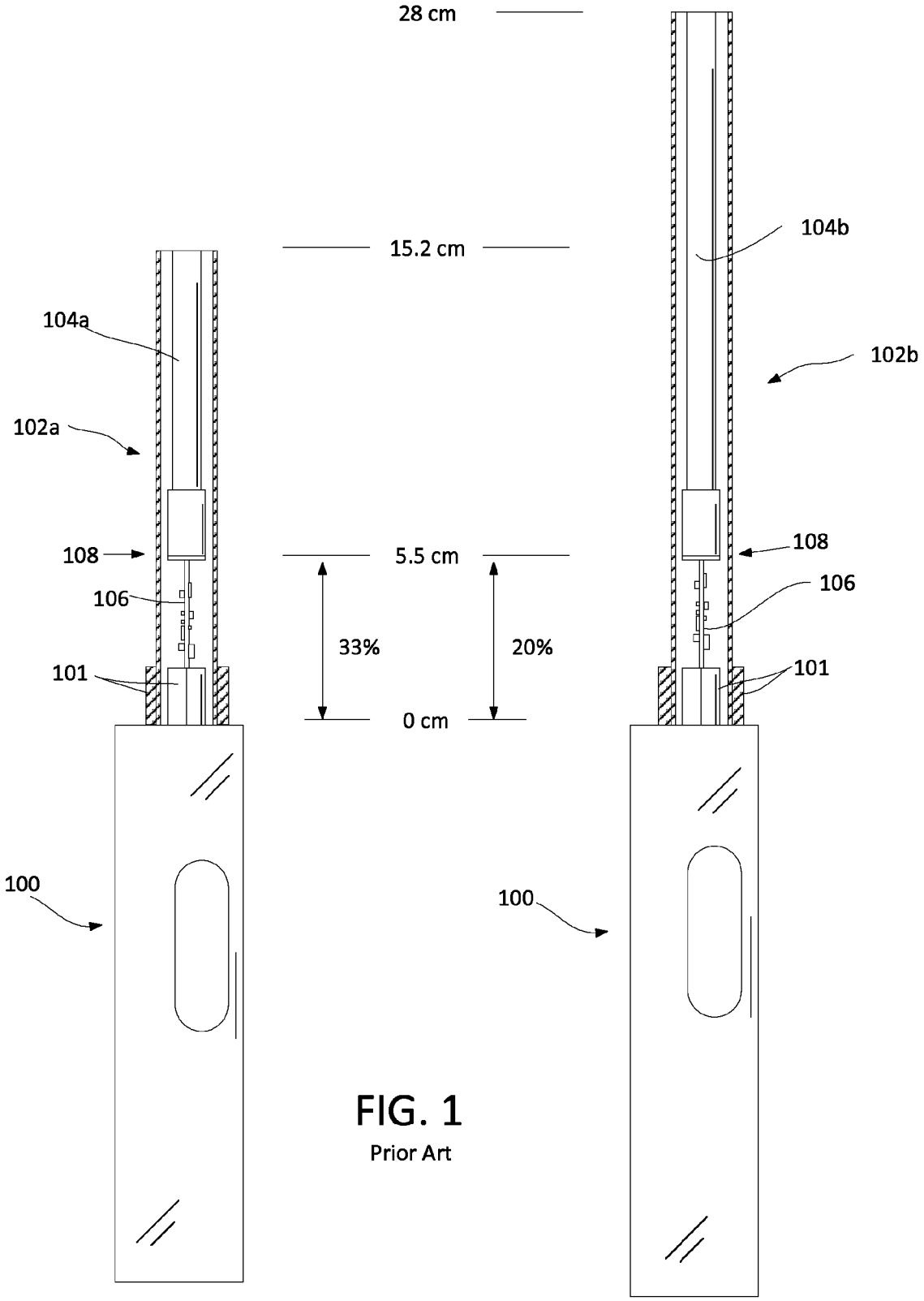
FIG. 1 Prior Art
FIG. 1 is a drawing that is useful for understanding the excess length that is normally required for matching networks in various conventional portable antenna systems.

The antenna pattern of certain physically small antennas can improve as the length of the antenna's radiating element is increased. For example, with reference to FIG. 1, there are shown a pair of portable communication devices 100. A first one of the portable communication devices has a first antenna 102*a* and a second one of the portable communication devices has a second antenna 102*b*. Each antenna is mounted on a portable communications device 100 at an antenna port 101. In this example, first antenna 102*a* has a first overall length (e.g. 15.2 cm. long) and the second antenna 102*b* has a somewhat longer length (e.g. 28 cm. overall length). Computer modeling shows that the first antenna 102*a*, with a shorter radiating element 104*a*, produces undesirable nulls in an elevation antenna pattern. Specifically, the undesirable nulls appear in the elevation pattern in the direction of the horizon at a certain frequency (870 MHz). In contrast, similar computer modeling can be used to show that the second antenna 102*b*, with a longer radiating element 104*b*, advantageously has a maximum gain in the direction of the horizon at the same frequency. Accordingly, the second antenna 102*b* can be preferred in certain communication applications because of its improved antenna pattern relative to first antenna 102*a*.

Still, it may be noted that only a portion of the overall length of each antenna 102*a*, 102*b* is devoted to a radiating element 104*a*, 104*b*, and it is the radiating element part of the antenna that primarily affects the antenna pattern. The remainder of the length of each antenna is devoted to the antenna matching network 106, which does not generally affect the antenna radiation pattern. In the example shown, the antenna matching network 106 consumes about 20% of the overall length of the antenna 102*b*, and about 33% of the overall length of antenna 102*b*. This means that a relatively large portion of the overall length of each antenna 102*a*, 102*b* is effectively wasted because it is used to accommodate the matching network 106 rather than the radiating element 104*a*, 104*b*.

Many antenna matching networks 106 are comprised of lumped elements including inductors, capacitors, and resistors. As will be appreciated by those skilled in the art, the size of an element or component in relation to the wavelength of energy propagated through the element, determines whether it is treated as a lumped element versus distributed element. If the size of the element or component is much smaller than a wavelength of the applied RF energy, then the element is normally considered a lumped element. In contrast, where the size of the component is approximately the same as or larger than the wavelength of applied RF energy, then the component functions as a distributed element. The antenna matching network can also include some length of conductors used to communicate RF signal. The conductors are commonly formed as conductive traces on a printed wiring board, and can couple RF energy to the one or more lumped components comprising the antenna matching network. In some cases, the conductive traces can be in the form of an RF transmission line, such as microstrip. In general, such conductive traces extend at least from the antenna connector 101, to a feed gap 108, which is located at a base end of the radiating element. As such, at least a portion of the conductive trace will extend in a direction which is generally parallel to the direction of the radiating element 104*a*, 104*b*.

Figure 2:
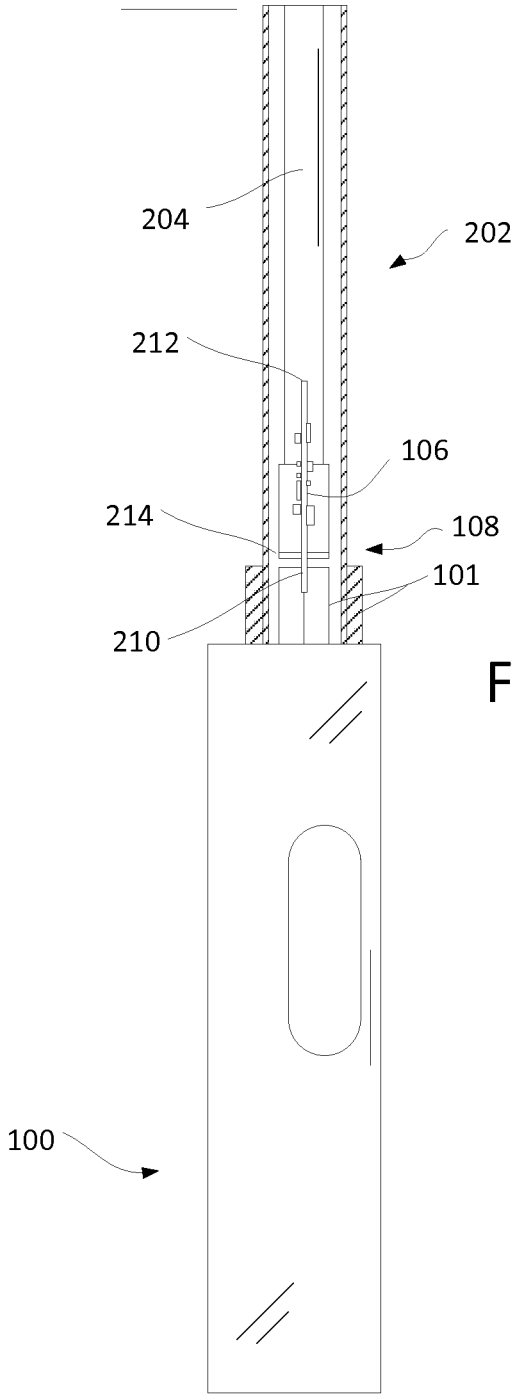
FIG. 2 is a drawing that is useful for understanding how a matching network can be positioned adjacent to an end portion of an antenna.

In order to provide for a longer radiating element, without increasing the overall length of the antennas 102*a*, 102*b*, a radiating elements 104*a*, 104*b* could be extended from the feed gap 108 to the antenna port 101. The antenna matching network 106 can be disposed adjacent to the radiating element. For example, if the antenna radiating element is formed as a hollow conductive tube, the matching network 106 can be disposed inside a hollow tubular portion of the antenna radiating element. Referring now to FIG. 2, there is shown an antenna 202 having a radiating element 204 which extends nearly adjacent to the antenna connector 101. The antenna matching network 106 is positioned adjacent to or inside a hollow portion of radiating element 204.

The conductive traces used to communicate RF energy to the components on the matching network 106 will generally need to extend from approximately a bottom end 210 toward a top end 212 of the matching network for communicating RF energy to the various components forming the matching network. In order for the antenna to continue to function as a true monopole antenna, the feed gap 108 must remain at the base end 214 of the radiating element 204 as shown. In order to complete this circuit, the conductive trace would also generally need to extend back from the top end 212 to the bottom end 210.

While the arrangement described with respect to FIG. 2 has its advantages, it also creates a problem. The problem arises because the conductive traces or wiring which comprise the matching network 106, will necessarily extend parallel and adjacent to at least a portion of the RF radiating element 204. Such an arrangement creates a problem due to the elongated conductors of the matching network which couple to the antenna feed gap. This coupling results in an undesirable reduction in antenna radiation resistance, which is explained below in further detail. One way to overcome this problem is to make the diameter of the tubular radiator relatively large, so as to minimize coupling to the feed gap. However, large diameter tubular radiators are not generally preferred. The inventive arrangements overcome these problems by facilitating the positioning the matching network's elongated conductors closer to the feed gap without the adverse effect of unwanted coupling.

Figure 3A:
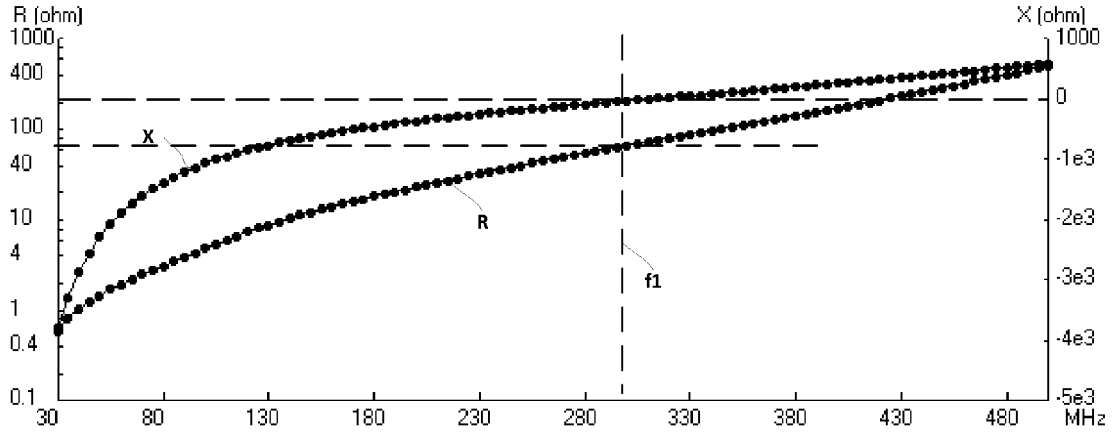
FIG. 3A-3C show a series of plots of radiation resistance and reactance for a dipole antenna under various conditions.
Figure 3B:
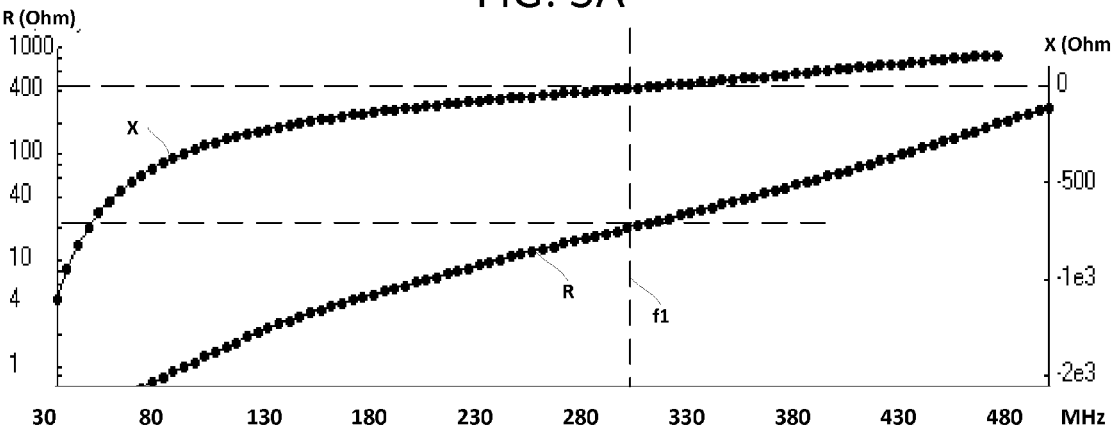
Figure 3C:
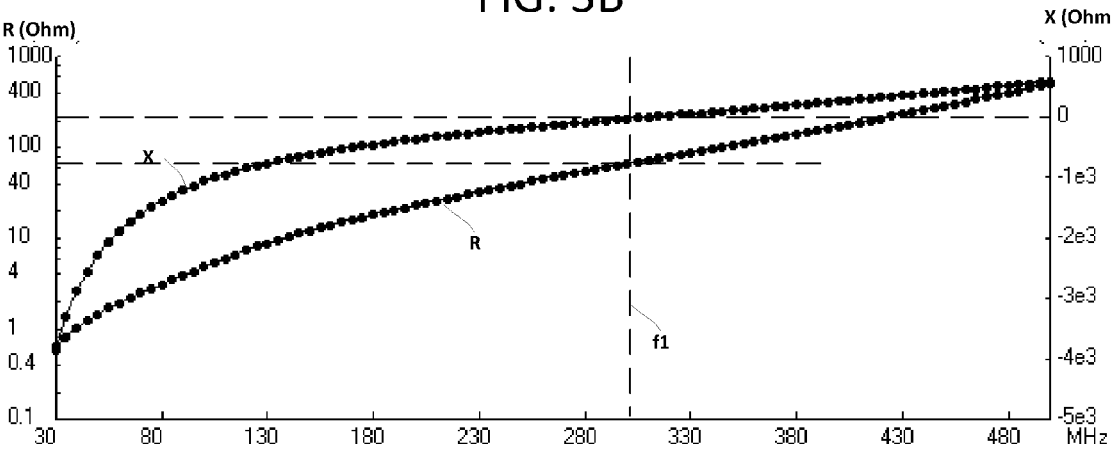
Figure 4A:
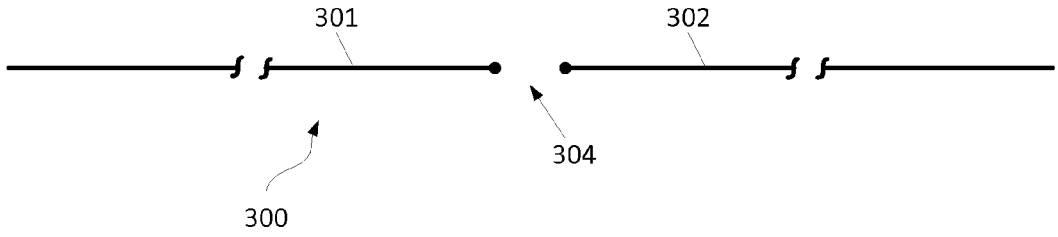
FIG. 4A-4C are a series of drawings that are useful for understanding the effects of nearby conductors on antenna radiation resistance.
Figure 4B:
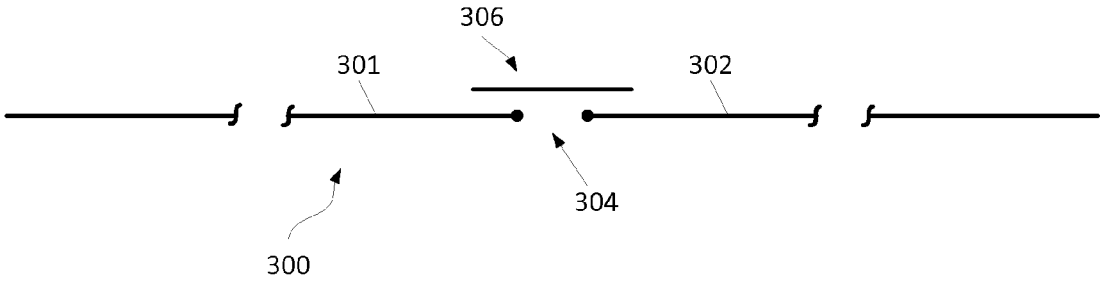

Referring now to FIGS. 3 and 4 there are provided a series of drawings to facilitate understanding of the radiation resistance problem noted above. With reference to FIG. 3A, there is shown a plot of antenna resistance and reactance versus frequency for a conventional dipole antenna as shown in FIG. 4A. The dipole 300 is comprised of a pair of radiating elements 301, 302 which extend in opposing directions from a feed gap 304. A dipole is chosen for this discussion due to its simple linear nature and to note the effects of conductors close to the dipole's feed gap. Those skilled in the art will appreciate that similar results are obtained for a monopole radiating element. Also, note that the antenna resistance shown in FIG. 3A is comprised of several terms, including (1) radiation resistance, (2) ohmic conductor losses, and (3) other losses. Typically the terms associated with items (2) and (3) will total less than about 1 ohm, so the radiation resistance is dominant component of the resistance values shown in the plot.

An antenna is most efficient (accepting energy and radiating energy) at the frequency where it has a purely resistive impedance (i.e., the reactance is zero). This condition is sometimes referred to as the resonant frequency. In FIG. 3A, computer modeling shows that the radiation resistance of the dipole antenna 300 is about 73 Ohms at frequency f1. In contrast, FIG. 3B shows the radiation resistance for the dipole antenna 300 in FIG. 4B. Note that in FIG. 4B a parallel conductor 306 extends parallel to the elongated axis or length of the antenna and extends across the antenna feed gap 304. It can be observed in FIG. 3B that the radiation resistance of the dipole antenna in FIG. 4B drops to about 20 Ohms due to the presence of the parallel conductor 306. In fact, such an undesirable drop in radiation resistance can result whenever the parallel conductor 306 has a length which extends over a portion of the feed gap 304.

Figure 4C:
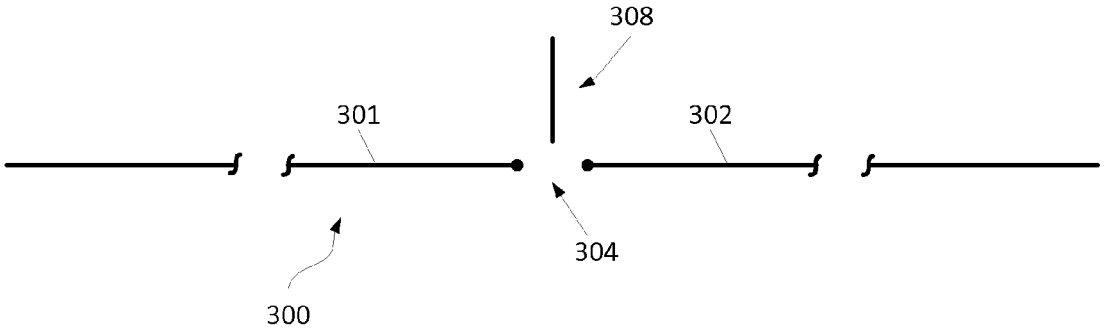

Referring now to FIG. 3C, there is provided another computer generated plot of radiation resistance for a dipole antenna 300 with a conductor located nearby to the antenna feed gap 304. In this example, which is shown in FIG. 4C, the conductor 308 extends in a direction that is generally orthogonal to the conductors forming the radiating elements. The computer model shows that radiation resistance is approximately the same for the antenna in FIGS. 4A and C. From this, it can be understood that a conductive wire or trace located near the feed of the dipole antenna has minimal effect on radiation resistance, provided that the wire or trace extends in a direction that is substantially orthogonal to the conductors forming the radiating element in the area near the antenna feed gap.

Dipole antennas, which have two radiating elements, are modeled in the plots shown in FIG. 3A-3C in order to illustrate the effects of elongated conductors placed in proximity to the antenna feed gap. Monopole antennas use the chassis of a portable communication device as a counterpoise in place of one of the radiating elements of a dipole antenna. However, those skilled in the art will appreciate that the effect of conductive traces or wires disposed near the feed of a monopole antenna is similar. It should be understood that FIGS. 3A-3C are not intended to represent the actual resistance of any particular antenna of the present invention. Instead, the various plots are provided to help conceptually understand the radiation resistance problem generally, and the reason why the embodiments of the invention offer certain advantages.

Figure 5:
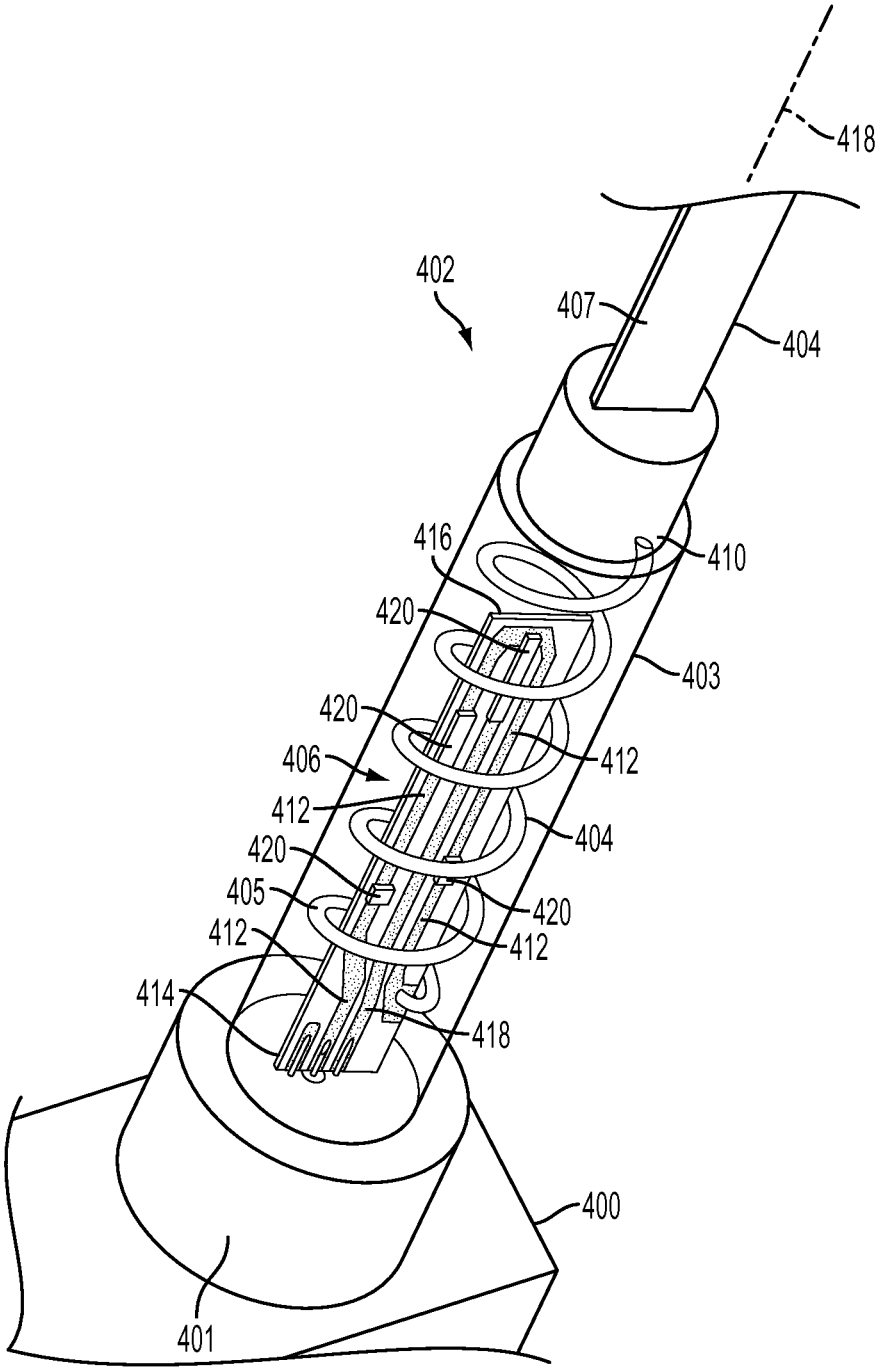
FIG. 5 is a drawing of an antenna that is useful for understanding how antenna radiation resistance can be controlled.
Figure 6:
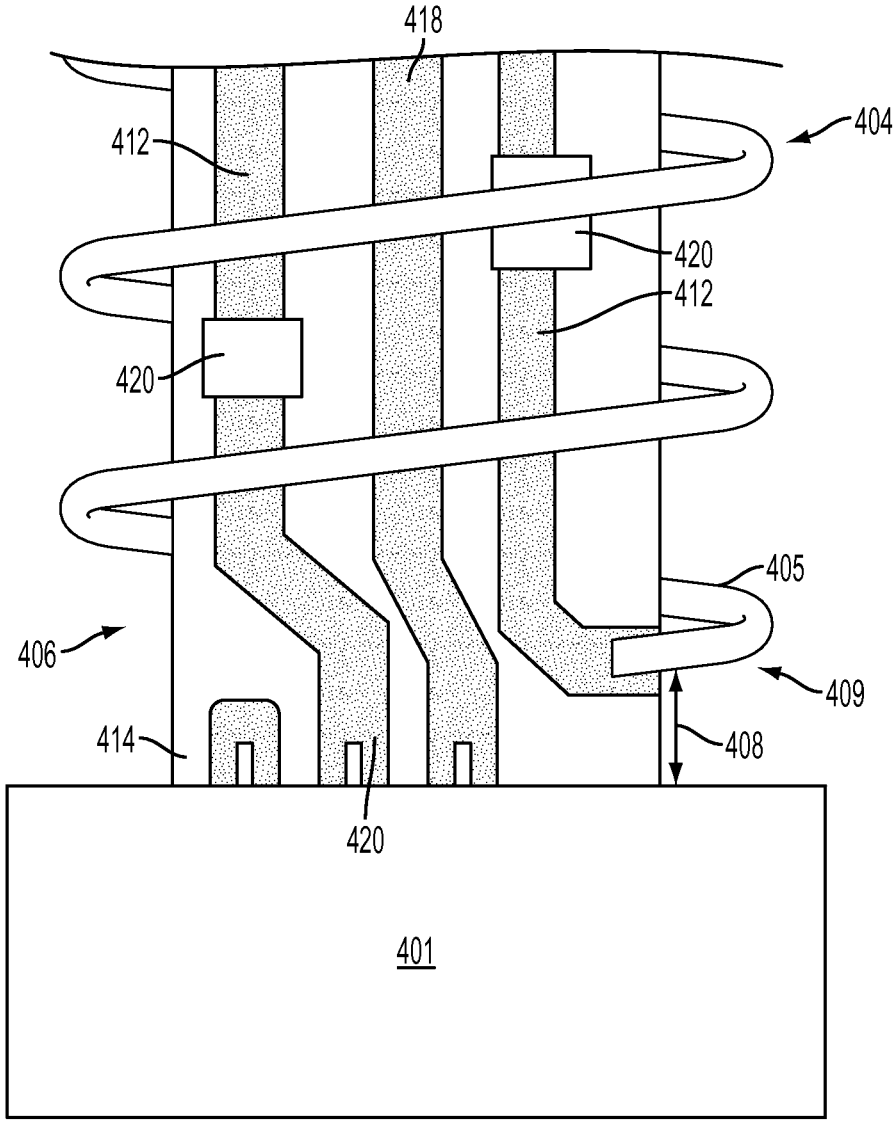
FIG. 6 is an enlarged view of a portion of the antenna in FIG. 5.

The above-described problem with radiation efficiency is solved in an embodiment of the invention shown in FIGS. 5 and 6. Note that the embodiment in FIGS. 5 and 6 is similar to the shortened antenna arrangement illustrated in FIG. 2, but includes certain design measures to ensure that the radiation resistance is not adversely effected by the inclusion of the matching network adjacent to the feed gap. The design measures will become more apparent as the discussion progresses.

The embodiment in FIGS. 5 and 6 comprises an antenna 402 formed of a radiating element 404. The antenna can be connected to a portable communication device 400 by means of a suitable RF connector 401. The radiating element 404 is an elongated conductive element comprised of a conductive wire 405 and can also include a flexible metal blade portion 407. The conductive wire 405 is shaped to have a helical form as shown, with a central helical axis. The helical axis is generally aligned with the antenna axis 418, which extends in a direction along the overall length of the antenna 402. The helical form can be disposed within a cylindrical housing 403 that is formed of a dielectric material. The flexible metal blade portion 407 is electrically connected to the conductive wire 405 by suitable means. For example, the conductive wire can be connected to a conductive metal ferrule 410, on which the flexible metal blade portion 407 is mounted. The details of this arrangement are not particularly important provided that the flexible metal blade portion and the conductive wire are capable of functioning in combination as a monopole antenna with a single radiating element 404.

The antenna 402 includes a matching network 406. The matching network can be comprised of a printed wiring board on which is mounted a plurality of lumped element components similar to those shown in FIGS. 1 and 2. Matching networks of this type are well known in the art and therefore will not be described here in detail. However, it should be noted that the matching network 406 generally include at least one elongated conductor 412 and at least one ground plane conductor 418. The elongated conductor 412 can be a wire, or a conductive trace disposed on the printed wiring board.

As can be observed in FIGS. 5 and 6, the elongated conductor 412 extends in a direction which is generally aligned with antenna axis 418 along the length of the antenna 402. A first portion of the conductor 412 extends from RF connector 401 at a location near the bottom end 414 of the matching network 406. From this location, the elongated conductor 412 extends to a location approximately at a top end 416 of the matching network. A second portion of the conductor 412 extends from the area proximate to the top end 416, to a location approximately adjacent the feed gap 408 near the bottom end 414.

The conductor 412 is electrically coupled to the radiating element 404 at the base end 409. The base end of the radiating element is the portion nearest to the chassis of portable communication device 400. According to a preferred embodiment, the conductor 412 can be galvanically connected to the radiating element 404 at base end 409, but the invention is not limited in this regard. Other types of inductive or capacitive coupling arrangements are also possible. The specific path of the conductor 412 as shown in FIGS. 5 and 6 is not intended to be limiting of the present invention. Instead, such path is shown merely by way of example to portray the concept that the conductor extends in a direction that is generally parallel to the overall length of the antenna 402.

In the embodiment of the invention shown in FIGS. 5 and 6, the matching network 406 is shown disposed inside the diameter of the helical coils forming the radiating element 404. However, it should be understood that the invention is not limited in this regard. In general, the method concerns techniques and methods for permitting a matching network with elongated conductors to be positioned adjacent or near to the feed gap of the antenna as shown while minimizing adverse effects with regard to radiation resistance. As such, the matching network 406 does not necessarily need to be positioned inside the coils of the helically shaped antenna radiating element 404. As used herein, the term adjacent or near generally refers to distances that are less than about ¼ wavelength at the frequency that the antenna is designed to operate.

When the elongated conductor 412 comprising the matching network 406 is close to and extends across the feed gap 408, the adverse effect upon radiation resistance will tend to be greater when the elongated conductor is aligned with the conductor forming the radiating element. As shown in FIG. 6, a portion 420 of the elongated conductor 412 does in fact traverse the distance across the feed gap 408. In the present invention, the helical form of the radiating element 402 in the vicinity of the feed gap 408 advantageously minimizes the negative effects of elongated conductor 412 upon the antenna resistance. In particular, this helical arrangement ensures that the conductive wire 405 forming the helical portion extends in a direction that is generally transverse to the elongated conductor 412, thereby avoiding the lowered antenna resistance problem described above in relation to FIG. 3B.

If the elongated conductor 412 forming the matching network is further from the feed gap, it will tend to have less interaction with the antenna with regard to radiation resistance. It should be understood that the invention is not limited to matching networks positioned at any particular distance from the feed gap. The invention includes any antenna where interaction between the antenna radiating element and a matching network situated near the antenna feed gap is minimized as hereinafter described by using a radiating element with a helical coil structure at or near the feed gap.

In a preferred embodiment, the coil diameter, wire diameter, and pitch of the helical coils forming the antenna radiating element 404 are selected using computer modeling. The pitch is the distance along the helix axis corresponding to one coil or turn. The modeling can include an iterative process in which coil diameter, wire diameter, and pitch are varied to determine the effect upon radiation resistance and other antenna parameters. Of course, such modeling and optimization must be limited by design constraints such as the desired overall length and diameter of the antenna. The iterative process can further involve selecting an optimal coil diameter, wire diameter, and pitch of the coils forming the helically wound radiating element 404. The pitch and diameter of the helical coils forming the radiating element are considered optimized when the maximum antenna performance is obtained relative to a set of design goals. These design goals can include desired values for radiation resistance, antenna gain, antenna impedance, antenna length, antenna diameter, power handling capability, and so on. The frequency range of interest can include a range of frequencies over which the antenna is designed to operate with relatively low Voltage Standing Wave Ration (VSWR).

The pitch, wire size and diameter of the coils forming radiating element 404 can be the same or different at different locations along the length of the antenna 402. For example, the pitch and coil diameter in the area surrounding the matching network can be selected based on computer modeling to minimize any decrease in radiation resistance caused by conductor 412. However, other portions of the radiating element 404 that are spaced at greater distances from the feed gap will generally tend to have less interaction with the matching network. Accordingly, the pitch and diameter of the helical coils at such locations is less critical, at least with regard to the problem of radiation resistance. Such other portions can have a different helical pitch and diameter or can have a linear form which is absent of any turns. In FIG. 5, one example of a linear form is presented by conductive metal blade portion 407 of the radiating element 404. Still, the invention is not limited in this regard and other linear antenna arrangements are also possible.

With the foregoing arrangements, the antenna matching network 406 can be disposed within or adjacent to a portion of the volume enclosed by the antenna radiating element 404. This permits a shorter antenna to be constructed which is shorter by comparison to the antenna illustrated in FIG. 1. The antenna shortening techniques described herein are not limited to monopole antennas as shown in FIGS. 1-4. Instead, these techniques can also be used on antennas having two or more radiators. For example, two radiators extending in opposing directions from a feed gap can be used to form a dipole arrangement, and the matching network can be disposed within a set of helical coils at the dipole antenna feed gap. Still, it should be understood that the invention is especially useful for recovering volume used for the matching network in the case of electrically short antennas.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

I claim:

1. An antenna, comprising:

at least one elongated radiating element having a length extending along an antenna axis, said radiating element having a first end portion including an RF feed gap, and a second end opposed to said first end portion;

at least a portion of said elongated radiating element closest to said feed gap arranged to have a helical form comprised of a plurality of coils having a helical axis centered on said antenna axis;

a matching network at least partially disposed within a volume enclosed by said plurality of coils, said matching network comprising a plurality of lumped element components, and including an elongated conductor extending in a direction aligned with said antenna axis; and wherein a conductor forming said plurality of coils extends in a direction that is substantially orthogonal to said elongated conductor of said matching network at least in an area of said elongated radiating element nearest said feed gap.

2. The antenna according to claim 1, wherein said helical form has a coil diameter, a coil pitch and wire diameter which, in combination, are of a configuration operative to achieve a diminution in a reduction in a radiation resistance of said antenna caused by a proximity of said elongated conductor to said feed gap.

3. The antenna according to claim 1, wherein substantially an entire elongated length of said matching network is disposed within the plurality of coils.

4. The antenna according to claim 1, further comprising an RF connector extending from said first end portion, and electrically coupled to said matching network.

5. The antenna according to claim 4, wherein said elongated conductor is electrically connected to said RF connector proximal to a bottom end of said matching network, extends along a path from said bottom end to a location proximal to an opposing top end, and then continues to a location proximal to said bottom end, where said elongated conductor is electrically coupled to said first end portion of said radiating element.

6. The antenna according to claim 1, wherein said matching network is operative to provide an impedance transformation to approximately match an impedance of said radiating element to a portable communication device over a range of frequencies.

7. The antenna according to claim 1, wherein said antenna comprises a monopole radiating element.

8. The antenna according to claim 1, wherein said antenna is a dipole and includes two of said elongated radiating elements.

9. A method for reducing a length of an antenna, comprising:

forming at least one elongated radiating element having a length extending along an antenna axis, said radiating element having a first end portion and a second end portion opposed to said first end portion;

arranging at least a portion of said elongated radiating element closest to said feed gap to have a helical form comprised of a plurality of coils, with said coils having a helical axis substantially centered on said antenna axis;

locating an RF feed gap at said first end portion;

coupling said RF feed gap to a matching network including an elongated conductor;

positioning said matching network at least partially within a volume enclosed by said plurality of coils so that said elongated conductor extends in a direction aligned with said antenna axis and substantially orthogonal to a conductor forming said plurality of coils at least in an area of said elongated radiating element nearest said feed gap; and selectively determining a coil diameter, a coil pitch and wire diameter of said helical form to achieve a decreased reduction in a radiation resistance of said antenna caused by a proximity of said elongated conductors to said feed gap.

10. The method according to claim 9, wherein substantially an entire elongated length of said matching network is disposed within the plurality of coils.

11. The method according to claim 9, further comprising positioning an RF connector at said first end portion of said radiating element, and electrically coupling said RF connector to said matching network.

12. The method according to claim 11, further comprising coupling said elongated conductor to said RF connector proximal to a bottom end of said matching network.

13. The method according to claim 12, further comprising selecting a path for said elongated conductor to run from said bottom end to a location proximal to an opposing top end, and then continuing to a location proximal to said bottom end, where said elongated conductor is coupled to said first end portion of said radiating element.

14. The method according to claim 9, further comprising selecting said at least one elongated radiating element to include only a single radiating element, such that said antenna comprises a monopole antenna.

15. The method according to claim 9, further comprising selecting said at least one monopole radiating element to include two radiating elements, such that said antenna comprises a dipole.

* * * * *